US008778097B2

(12) United States Patent
Chin et al.

(10) Patent No.: US 8,778,097 B2
(45) Date of Patent: Jul. 15, 2014

(54) LOW SPECIFIC GRAVITY AND HIGH STRENGTH STEEL SHEETS WITH EXCELLENT RIDGING RESISTIBILITY AND MANUFACTURING METHODS THEREOF

(75) Inventors: Kwang Geun Chin, Gwangyang (KR); Jai Hyun Kwak, Gwangyang (KR)

(73) Assignee: Posco, Pohang (KR)

( * ) Notice: Subject to any disclaimer, the term of this patent is extended or adjusted under 35 U.S.C. 154(b) by 399 days.

(21) Appl. No.: 12/260,144

(22) Filed: Oct. 29, 2008

(65) Prior Publication Data

US 2009/0297387 A1 Dec. 3, 2009

(30) Foreign Application Priority Data

May 27, 2008 (KR) ..... 10-2008-0049202

(51) Int. Cl.

| | |
|---|---|
| ***C22C 38/00*** | (2006.01) |
| ***C22C 38/04*** | (2006.01) |
| ***C21D 8/02*** | (2006.01) |
| ***C22C 38/06*** | (2006.01) |
| ***C22C 38/18*** | (2006.01) |
| ***C22C 38/08*** | (2006.01) |
| ***C22C 38/12*** | (2006.01) |
| ***C22C 38/14*** | (2006.01) |

(52) U.S. Cl.

USPC ..... 148/337; 148/329; 148/602; 148/603; 420/72; 420/77; 420/79; 420/80; 420/81

(58) Field of Classification Search

USPC ..... 420/72, 77, 79, 80, 81; 148/603, 329, 148/337, 602

See application file for complete search history.

(56) References Cited

U.S. PATENT DOCUMENTS

| | | | | |
|---|---|---|---|---|
| 6,328,826 | B1 | 12/2001 | Iung et al. | |
| 6,387,192 | B1 | 5/2002 | Frommeyer et al. | |
| 7,416,615 | B2 | 8/2008 | Bano et al. | |
| 7,754,030 | B2 | 7/2010 | Okitsu | |
| 2003/0196735 | A1 * | 10/2003 | Sugiura et al. | 148/602 |
| 2004/0159373 | A1 | 8/2004 | Ikeda et al. | |
| 2006/0231177 | A1 | 10/2006 | Bano et al. | |
| 2007/0119521 | A1 | 5/2007 | Yokota et al. | |
| 2008/0131305 | A1 * | 6/2008 | Okitsu | 420/106 |
| 2008/0240969 | A1 | 10/2008 | Kim et al. | |

FOREIGN PATENT DOCUMENTS

| | | | |
|---|---|---|---|
| CN | 1782116 | A | 6/2006 |
| CN | 1970812 | A | 5/2007 |
| DE | 19610675 | C1 | 2/1997 |
| DE | 102004061284 | A1 | 7/2005 |
| DE | 102005052774 | A1 | 6/2006 |
| EP | 0889144 | A1 | 1/1999 |
| EP | 1389639 | A2 | 2/2004 |
| JP | 8060305 | A | 3/1996 |
| JP | 2001073040 | A | 3/2001 |
| JP | 2003193213 | A | 7/2003 |
| JP | 2005060728 | A | 3/2005 |
| JP | 2005527701 | A | 9/2005 |
| JP | 2005273004 | A | 10/2005 |
| JP | 2005298848 | A | 10/2005 |
| JP | 2005325388 | A | 11/2005 |
| JP | 2006176843 | A | 7/2006 |
| WO | 2006059653 | A1 | 6/2006 |
| WO | 2006066551 | A1 | 6/2006 |
| WO | WO 2006059653 | A1 * | 6/2006 |
| WO | 2007024092 | A1 | 3/2007 |

OTHER PUBLICATIONS

Davis et al., Surface Engineering of Irons and Steels-Hot Dip Coating Processes, ASM Handbook, 1994, ASM International, vol. 5, p. 712-721.*

Bramfitt et al., Annealing of Steel, ASM Handbook, 1991, ASM International, vol. 4, p. 42-53.*

B.C. De Cooman et al., "Mechanical Properties of Low Alloy Intercritically Annealed Cold Rolled Trip Sheet Steel Containing Retained Austenite", Canadian Metallurgical Quarterly, 2004, pp. 13-24, vol. 43, No. 1, Canadian Institute of Mining, Metallurgy and Petroleum, Canada.

Udo Brux et al., "High-Strength Light-Weight Steels Based on Fe-Mn-Al-C Microstructures—Mechanical Properties", Proceedings of Plasticity '03: The Tenth International Symposium on Plasticity and its Current Applications, Jan. 1, 2003, pp. 169-171, Univ. of Maryland Baltimore County, International Journal of Plasticity, Numerical Engineering Analysis and Testing (NEAT), Inc., USA.

* cited by examiner

*Primary Examiner* — Roy King
*Assistant Examiner* — Caitlin Kiechle
(74) *Attorney, Agent, or Firm* — The Webb Law Firm

(57) ABSTRACT

A low specific gravity and high strength steel sheet includes C of 0.2% to 0.8%, Mn of 2% to 10%, P of 0.02% or less, S of 0.015% or less, Al of 3% to 15%, and N of 0.01% or less. A ratio of Mn/Al is 0.4 to 1.0. Retained austenite in a structure is included in the range of 1% or more. The steel sheet further includes one or two or more elements selected from the group consisting of Si of 0.1% to 2.0%, Cr of 0.1% to 0.3%, Mo of 0.05% to 0.5%, Ni of 0.1% to 2.0%, Cu of 0.1% to 1.0%, B of 0.0005% to 0.003%, Ti of 0.01% to 0.2%, Zr of 0.005% to 0.2%, Nb of 0.005% to 0.2%, W of 0.1% to 1.0%, Sb of 0.005% to 0.2%, and Ca of 0.001% to 0.2%.

15 Claims, 2 Drawing Sheets

LOW SPECIFIC GRAVITY AND HIGH STRENGTH STEEL SHEETS WITH EXCELLENT RIDGING RESISTIBILITY AND MANUFACTURING METHODS THEREOF

CROSS-REFERENCE TO RELATED APPLICATIONS

This application claims the priority of Korean Patent Application No. 10-2008-0049202, filed on May 27, 2008 in the Korean Intellectual Property Office, the disclosure of which is incorporated herein by reference.

BACKGROUND OF THE INVENTION

1. Field of the Invention

The present invention relates to a method of manufacturing a high strength steel sheet which is generally used for inner and outer steel sheets of a structural member for an automobile, and more particularly, to ferrite-based high strength and lowgravity steel sheets, which have lower specific gravity and higher specific strength as compared to conventional high strength steel sheets, and have excellent ridging resistibility and ductility for preventing ridging from occurring due to severe machining such as drawing or the like, and a manufacturing method thereof.

2. Description of the Related Art

Recently, steel sheets for an automobile show a tendency toward more excellent formability owing to the complexity and integration of automobile moldings as well as gradual increase in requirements for strength and weight for the purpose of reduction in fuel expenses and improvement in safety upon collision of the automobile. Because of very excellent strength and ductility, and very low cost as compared to aluminum or magnesium, steel has been generally used to make a body of the automobile lightweight through thinning of a high strength and ductility steel plate up to now. However, in order to overcome a future limitation to the reduction in weight, it is inevitable to use nonferrous lightweight metal.

In the prior art, there was used steel to which a lightweight element, Al, is generally added so as to reduce specific gravity thereof. For example, there was proposed a method of manufacturing ferrite steel by adding 2.0 wt % to 10.0 wt % Al to very low carbon steel.

However, in the case of the ferrite steel, problems arise that it has only elongation of about 25%, and there is no solution to eliminate a so-called ridging phenomenon that upon machining such as deep drawing or the like, irregular linear striped defects are generated on the machined surface, so that the surface of the steel sheet becomes degraded, and the deep-drawn portion is broken.

SUMMARY OF THE INVENTION

An aspect of the present invention provides a method of manufacturing a ferrite-based low specific gravity and high strength steel sheet as lightweight material of an automobile, in which alloy elements are adequately added, thereby having tensile strength of 600 Mpa or more, excellent ductility, and excellent ridging resistibility owing to reduction in ridging upon machining.

According to an aspect of the present invention, there is provided a low specific gravity and high strength steel sheet, which comprises C: 0.2% to 0.8%, Mn: 2% to 10%, P: 0.02% or less, S: 0.015% or less, Al: 3% to 15%, and N: 0.01% or less, wherein a ratio of Mn/Al is 0.4 to 1.0. Here, the steel sheet may further comprise one or two or more elements selected from the group consisting of Si: 0.1% to 2.0%, Cr: 0.1% to 0.3%, Mo: 0.05% to 0.5%, Ni: 0.1% to 2.0%, Cu: 0.1% to 1.0%, B: 0.0005% to 0.003%, Ti: 0.01% to 0.2%, Zr: 0.005% to 0.2%, Nb: 0.005% to 0.2%, W: 0.1% to 1.0%, Sb: 0.005% to 0.2%, and Ca: 0.001% to 0.2%.

According to another aspect of the present invention, there is provided a low specific gravity and high strength galvanized steel sheet comprising one of coating layers consisting of Zn, Zn—Fe, Zn—Al, Zn—Mg, Zn—Al—Mg, Al—Si, and Al—Mg—Si at a thickness of 10 μm to 200 μm per one side thereof.

According to a further aspect of the present invention, there is provided a method of manufacturing a low specific gravity and high strength hot-rolled steel sheet using a steel slab comprising C: 0.2% to 0.8%, Mn: 2% to 10%, P: 0.02% or less, S: 0.015% or less, Al: 3% to 15%, and N: 0.01% or less, wherein a ratio of Mn/Al is 0.4 to 1.0. The method comprises the steps of: heating the steel slab within a range between 1000° C. and 1200° C., hot-rolling the steel slab within a range between 700° C. and 850° C., and coiling the hot-rolled steel slab at 600° C. or less.

According to other aspect of the present invention, there is provided a method of manufacturing a low specific gravity and high strength hot-rolled steel sheet using a steel slab comprising C: 0.2% to 0.38, Mn: 2% to 10%, P: 0.02% or less, S: 0.015% or less, Al: 3% to 15%, and N: 0.01% or less, wherein a ratio of Mn/Al is 0.4 to 1.0. The method comprises the steps of: heating the steel slab within a range between 1000° C. and 1200° C., hot-rolling the steel slab within a range between 700° C. and 850° C., coiling the hot-rolled steel slab at 600° C. or less, cold-rolling the hot-rolled steel slab at a rolling reduction of 40% to 90%, and annealing the cold-rolled steel slab within a temperature range between recrystallization temperature and 900° C. at an annealing rate of 1° C./s to 20° C./s for a time of 10 to 180 seconds.

According to a yet another aspect of the present invention, there is provided a method of manufacturing a low specific gravity and high strength cold rolled steel sheet using a steel slab comprising C: 0.2% to 0.8%, Mn: 2% to 10%, P: 0.02% or less, S: 0.015% or less, Al: 3% to 15%, and N: 0.01% or less, wherein a ratio of Mn/Al is 0.4 to 1.0. The method comprises the steps of: heating the steel slab within a range between 1000° C. and 1200° C., hot-rolling the steel slab within a range between 700° C. and 850° C., coiling the hot-rolled steel slab at 600° C. or less, cold-rolling the hot-rolled steel slab at a rolling reduction of 40% to 90%, annealing the cold-rolled steel slab within a temperature range between recrystallization temperature and 900° C. at an annealing rate of 1° C./s to 20° C./s for a time of 10 to 180 seconds, and coating the annealed steel slab with one of coating layers consisting of Zn, Zn—Fe, Zn—Al, Zn—Mg, Zn—Al—Mg, Al—Si, and Al—Mg—Si at a thickness of 10 μm to 200 μm per one side thereof.

According to the hot-rolled steel plate, the cold rolled steel sheet, and the galvanized steel sheet of the present invention, retained austenite and carbide are dispersed in a ferrite matrix so as to provide high strength having tensile strength of 600 to 1000 Mpa, and excellent ridging resistibility and ductility because of having the ridging level of 10 μm or less after 5% elongation, having a great effect on lightening of the body of an automobile.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
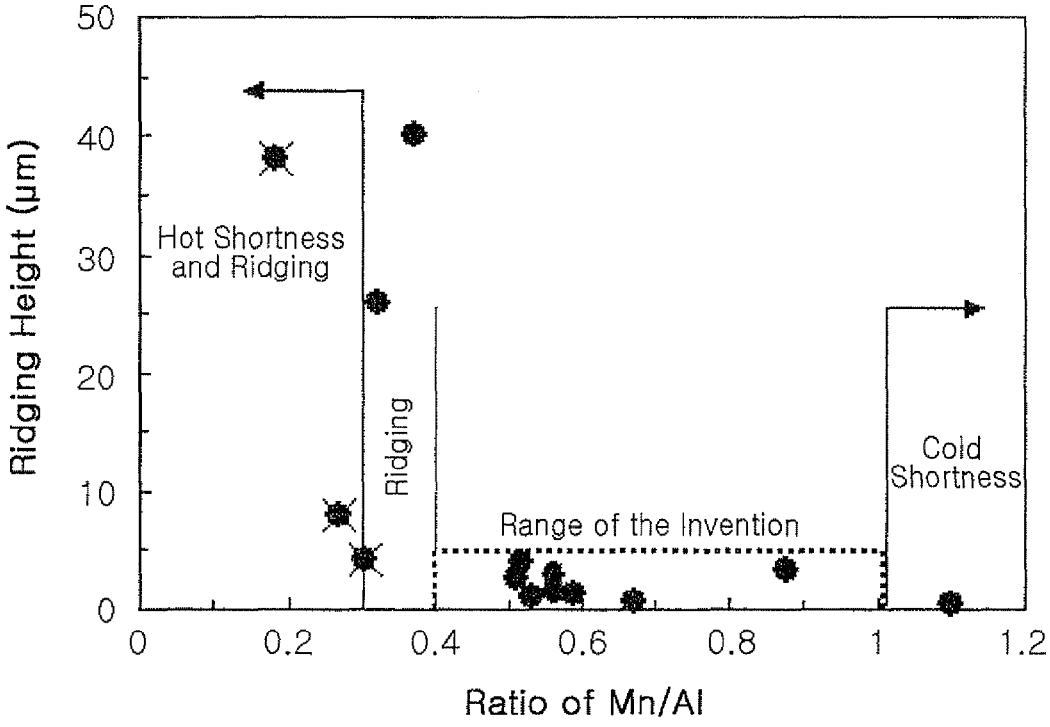
FIG. 1 is a graphical representation illustrating relation between Mn/Al ratio and ridging level.

The present invention provides effective means for restricting grain-coarsening in orientations {001}<110> to {112}<110> which may occur during re-heating and rolling for the refinement and hot rolling of columnar dendrite in order to remove defect of ridging of low specific gravity, high ductility, and high strength steel. This means uses fine carbide and austenite transformation for, upon re-heating, restricting grain-coarsening during hot rolling of a slab manufactured by continuous casting. To this end, an element, such as C, Mn, Al or the like is restricted, an alloy element such as Ti or the like is added, and process parameters of such as hot rolling and cold rolling are restricted.

The principle and method of restricting ridging of a steel sheet according to the present invention will now be described in detail.

As set forth above, the ridging is problematic when in the structure of the steel, coarse crystal grains in orientations {001}<110> to {112}<110>, which have poor workability, are distributed intersecting with the texture of {111}<110> to {111}<112> like a fabric structure, and they are elongated or drawn. In such a structure, upon being elongated or drawn, there occurs a difference in contraction rate in a thickness direction, with a result that a great quantity of residual stress is concentrated upon a boundary thereof, causing, to a finished product, irregular shaped defects or in severe case, even local deformation owing to a difference of excessive local contraction and therefore breakage.

In the case of low specific gravity steel of the present invention in which particularly, the great quantity of Al is added, a transformation into a single phase of ferrite does not occur, so that columnar dendrite, which is created during casting, is coarsely grown when being slab-annealed after cooling, and then it is not removed, finally causing defects.

Accordingly, through researches into the restriction of ridging in low specific gravity steel, the inventors have completed the present invention by the processes of the refinement of a structure using an austenite transformation via composition control, and the further control of rolling process parameters.

That is, the texture in orientations of {001}<110> to {112}<110>, which causes the ridging as set forth above, results from a coarse ferrite structure. Thus, according to the present invention, a refinement process is essential after holt rolling, so that to this end, precipitate, such as Ti, Zr, Nb, W, Cr or the like, is used while an Mn/Al ratio is controlled, or otherwise upon continuous casting, the rate of the casting is controlled at a temperature at which columnar dendrite are developed and grown, and electronic agitation is carried out thereto, thereby maximizing a ratio of equiaxed dendrite, not columnar dendrite, to all over the thickness.

Hereinafter, the composition of the present invention will be described in detail (on the basis of weight %).

C: 0.2 to 0.8%

C serves to create cementite [$(Fe,Mn)_3C$] and kappa carbide [$(Fe,Mn)_3AlC$], stabilize austenite, and provide dispersion strengthening by cementite. Particularly, since the columnar dendrite created during continuous casting is rapidly re-crystallized so as to create a coarse structure, the formation of high temperature carbide is implemented to refine the structure and addition of C by 0.2% or more is implemented to increase the strength. However, if the added amount of C increases, the cementite and kappa carbide increase to contribute to an increase in strength, but greatly decrease ductility of steel. In the steel to which Al is added, particular, kappa carbide is precipitated on a grain boundary of ferrite to cause brittleness, so that the upper limit of C is restricted to 0.8%.

Mn: 2 to 10%

Mn contributes to the control of a property of carbide and formation of austenite at high temperature, together with C. Mn coexists with C, particularly so as to promote high temperature precipitation of carbide and therefore restrict the formation of carbide on a grain boundary to thereby restrict hot shortness, finally contributing to the strength improvement of steel. Further, Mn increases a lattice constant of steel to decrease the density thereof and thus specific gravity thereof, so that the added amount reaches 2% or more. However, if the amount is excessive, the occurrence of central segregation of Mn and an excessive band structure in a hot rolled sheet is caused to decrease ductility, so that the upper limit is restricted to 10%.

P: 0.02% or Less

P is an element which is added in an amount as small as possible. P is segregated on a grain boundary to cause hot shortness and cold shortness, so that workability of steel may be greatly reduced. Further, if a great quantity of P is added, a texture in orientation <100> develops to increase ridging, so that the upper limit of P is restricted to 0.02%.

S: 0.015% or Less

Similar to P, S promotes hot shortness. Particularly, it creates coarse MnS, particularly, which upon hot rolling and cold rolling, causes a rolling plate to be broken, so that it is limited to 0.015% or less.

Al: 3% to 15%

Al is a most important element in the present invention, together with C and Mn. Addition of Al decreases specific gravity of steel, so that the amount of addition is 3% or more. Taking into consideration the decrease in specific gravity, it is preferred that a great quantity of Al be added. However, if Al is excessively added, intermetallic compound such as kappa carbide, FeAl, or $Fe_3Al$ increases to greatly reduce the ductility of steel, so that the upper limit is restricted to 15%.

N: 0.01% or Less

N causes crystallization of AlN if a great quantity of Al is added as in the present invention, so as to be effective for the refinement of columnar dendrite and improvement in a ratio of equiaxed dendrite. However, the expenses required to increase the amount of N are increased, and the ductility may be abruptly reduced thanks to the clogging of a nozzle and precipitation. Thus, the upper limit of N is restricted to 0.01%.

Mn/Al: 0.4 to 1.0

Nevertheless to satisfy the above alloy composition, it needs that the amount of Al is controlled in association with the amount of Mn in order to restrict ridging, prevent the occurrence of hot crack, and improve high ductility. If the ratio of Mn/Al is below 0.4, a duplex structure of ferrite and carbide is formed, the coarsening of a hot rolled structure is unavoidable because of Al segregation and the coarsening of columnar dendrite, and the creation of excessive ridging and rolling crack is caused thanks to the formation of kappa carbide on a grain boundary. If the ratio of Mn/Al is 0.4 or more, the coarse columnar dendrite is not formed, avoiding the formation of coarse grains in orientations of {001}<110> to {112}<110>, which causes the ridging, and further restricting the precipitation of kappa carbide on a grain boundary and preventing the creation of crack occurring by high temperature intergranular fracture. However, if the ratio of Mn/Al exceeds 1.0, austenite transformation occurs at high temperature to increase a fraction of a secondary phase, and upon cooling, martensite transformation occurs to excessively increase the strength, but decrease the ductility. This is the reason why the upper limit is restricted to 1.0. In the case of existing lightweight steel, the ratio of Mn/Al is relatively small. Even when the ratio is about 0.35, the existing steel has composition vulnerable to hot shortness and ridging, or otherwise has low carbon content so that retained austenite is not substantially created, which causes insufficient strength and ductility. Further, in the case of the existing steel having relatively high ratio of Mn/Al of about 2.5, as a faction of a secondary phase increases, the strength also increases to thereby greatly increase the load of cold rolling and create cold shortness during rolling as well.

In addition to the above basic composition of the present invention, in order to improve or compensate the strength, ductility, and the other physical properties of steel, the very small amount of one or two or more elements of the group consisting of Si, Cr, Mo, Ni, Cu, B, Ti, Zr, Nb, W, Sb and Ca may be added.

Si: 0.1 to 2.0%

Similar to Al, Si decreases the specific gravity of steel and contributes to the improvement in strength, but if being excessively added, it may create a thick, irregular high temperature oxide film on the surface of steel, and greatly decrease the ductility of steel. Thus, it is preferred that the amount be as low as possible within the range of 0.1 to 2.0%.

Cr: 0.1% to 0.3%

Cr is a ferrite-forming element which forms Cr-based carbide and serves to refine a structure, so that the amount can be 0.1% or more. However, if added too much, ductility is reduced, so that the upper limit is restricted to 0.3%.

Mo: 0.05% to 0.5%

Similar to Cr, Mo is a ferrite-forming element which forms fine carbide, and is added by 0.05% or more. However, if excessively added, it decreases the ductility of steel, so that the upper limit thereof is restricted to 0.5%.

Ni: 0.1% to 2.0%

Ni an austenite-forming element, which introduces partial austenite during hot rolling to refine a structure, to thereby greatly improve the ridging resistibility. However, the price is expensive to increase the manufacturing cost, so that the limit is restricted to a range of 0.1 to 2.0%.

Cu: 0.1% to 1.0%

Cu acts similar to Ni, but the price is lower than Ni, so that it can be added in the range of 0.1% or more. However, if excessively added, it exists on a grain boundary in a liquid state to cause intergranular brittleness, owing to fused metal, and the occurrence of saw ear of a cold-rolled plate, so that the amount is restricted to a range of 0.1 to 1.0%.

B: 0.0005% to 0.003%

B restricts the recovery and recrystallization of ferrite in the process of hot rolling so as to contribute to the structure refinement thanks to cumulative rolling reduction and increase the strength of steel, so that the amount is 0.0005% or more. However, if excessively added, it creates boro-carbide, decrease the ductility of steel, and deteriorate the wettability of a hot-dipped galvanized coating layer, so that the upper limit is restricted to 0.003%.

Ti: 0.01% to 0.2%

Ti forms TiN, TiC or the like to thereby improve the ratio of equiaxed dendrite and the grain refinement in a cast structure and contribute to dispersion of kappa carbide, so that it is added in the range of 0.01% or more. However, it is expensive so as to increase the manufacturing cost, and it reduces ductility thanks to increase in strength through precipitation, so that the upper limit is restricted to 0.2%.

Zr: 0.005% to 0.2%

Zr acts similar to Ti, and forms strong nitride and carbide relative to Ti, so that it is added in the range of 0.005% or more. However, it is expensive to thereby increase the manufacturing cost, so that the upper limit is restricted to 0.2%.

Nb: 0.005% to 0.2%

Nb acts similar to Ti, and thus it is added in the range of 0.005% or more. However, unlike Ti, it certainly delays solid-solution strengthening and recrystallization at high temperature to thereby greatly increase the rolling load of hot rolling. This may make it impossible to manufacture a thin steel sheet, so that the upper limit is restricted to 0.2%.

W: 0.1% to 1.0%

W is a heavy element serving to increase the specific gravity of steel, but also form W carbide, thereby contributing to the refinement of carbide and the creation of ferrite, so that it is added within a range of 0.1 to 1.0%.

Sb: 0.005% to 0.2%

Sb is another important element in the present invention. Sb is segregated on a grain boundary to decrease boundary energy and thus restrict the formation of kappa carbide, and to further restrict the intergranular diffusion of carbon or aluminum and thus both reduce the amount of surface-enrichment and thin the thickness of an oxide of surface-enriched element, such as Al, Mn or the like, thereby improving the alloying efficiency and a surface feature, so that Sb is added in the range of 0.005% or more. However, if excessively added, Sb is segregated on a grain boundary to degrade ductility, so that the upper limit thereof is restricted to 0.2%.

Ca: 0.001% to 0.2%

Ca formed coarse sulfide such as CaS, so that it is added in the range of 0.001% or more to improve hot workability of steel. However, if Ca, a volatile element, is excessively added in the smelting process, the added amount of alloy iron is greatly increased to decrease the ductility of steel, so that the upper limit is restricted to 0.2%.

Description will now be made of a fraction of retained austenite included in the steel sheet of the present invention.

The steel sheet of the invention includes a retained austenite structure. The retained austenite complements the low strength of a ferrite matrix structure and also contributes to improvement in ductility thereof, so that it is included in the range of 1% or more by area. While the retained austenite has excellent quality as it is included in great quantities, when considering merchantability of the steel sheet, the upper limit thereof is preferably restricted to 30%.

Hereinafter, a manufacturing method of the high strength and low specific gravity steel sheet will be described in detail.

Re-Heating Temperature: 1000° C. to 1200° C.

In order to manufacture the steel sheet of the invention, a slab is first heated in the temperature range of 1000 to 1200° C. If the re-heating temperature exceeds 1200° C., coarse grains are formed in the slab, possibly creating ridging and hot shortness, whereas if it is below 1000° C., the finishing hot-rolling temperature is too low to both manufacture a steel sheet and remove an oxide film on a high temperature surface using the spraying of pressurized water, thereby causing surface defects. Thus, the re-heating temperature is restricted to 1000 to 1200° C.

Finishing Hot-Rolling Temperature: 700° C. to 850° C.

Since the hot rolling is implemented at a temperature as low as possible so as to effectively obtain fine grains, according to the present invention, the finishing rolling is implemented at a temperature of 850° C. or less in order to refine crystal grains. However, if the temperature is too low, heat deformation resistance increases to make it difficult to manufacture a steel sheet, and kappa carbide is precipitated to provide elongated structures, thereby increasing ridging defects, so that the rolling temperature is in the range of 700° C. or more.

Coiling Temperature: 600° C. or Less

The hot-rolled steel sheet is coiled at a temperature of 600° C. or less. This temperature restricts the coarsening and excessive-precipitation of kappa carbide as well as the formation of abnormally coarsened grains occurring by the secondary recrystallization of the coarsened grains.

The resulting hot-rolled material can be manufactured into a hot-rolled steel sheet after being treated with pickling, and temper rolling and oiling. According to the present invention, the steel sheet is low specific gravity steel sheet having the specific gravity of 7.2 g/cm$^3$ or less.

Further, the hot-rolled steel sheet can be manufactured into a cold rolled steel sheet after being treated with pickling and cold rolling.

Cold Rolling Reduction: 40% or More

In the cold rolling, cold rolling reduction is set to 40% or more. This is because, if the cold rolling reduction is set to 40% or more, stored energy by cold working can be secured, and a new recrystallized structure can be obtained. The coarse crystal grains, particularly in orientations of {001}<110> to {112}<110>, which causes the ridging, are subject to facture as the cold rolling reduction is high, and then in the process of annealing, can be recrystallized into {111}<110> to {111}<112> texture effective for the restriction of the ridging. Thus, the cold rolling reduction is selected by 40% or more as high as possible. However, the upper limit thereof is restricted to 90% or less in consideration of production efficiency and economy.

Annealing Rate: 1° C./s to 20° C./s

The cold rolled steel sheet is treated with continuous annealing or continuous hot-dip galvanizing after rolling oil is removed from the surface thereof. Here, the annealing rate is selected in the range of 1° C./s to 20° C./s. If the annealing rate is less than 1° C./s, productivity is too lowered, and the steel sheet is exposed to high temperature condition for a long time to thereby cause the coarsening of crystal grains and reduction in strength, deteriorating the quality of material. On the other hand, if the annealing rate exceeds 20° C./s, because of insufficient re-melting of carbide, the formation of austenite also becomes insufficient and thus retained austenite is reduced to thereby reduce the ductility.

Annealing at Ferrite-Recrystallization Temperature to 900° C. for 10 to 180 Seconds Annealing is implemented in the temperature range between recrystallization temperature and 900° C. Below the recrystallization temperature, it is difficult to secure ductility because of retained work hardened structure, and above 900° C., because of the formation of coarsened grains, the ductility increases, but the strength decreases, and the occurrence of the ridging increases. {111} texture, particularly effective for the restriction of the ridging, is developed and grown in the initial growth stage, so that it needs sufficient soaking time. Thus, the annealing is carried out for 10 seconds or more so as to strengthen the {111} texture, which has excellent strength and workability, and is effective for the restriction of the ridging. However, if the annealing time exceeds 180 seconds, the productivity is excessively lowered, and since an annealing furnace and a plating apparatus are provided into a single apparatus, an alloying time with zinc bath during hot-dip galvanizing increases, which has a bad effect on corrosion resistance and surface characteristics.

Then, the steel sheet is cooled to 400° C. at a cooling rate of 1 to 100° C./s, and then is incubated in a conventional manner, or otherwise for securing corrosion resistance, is coated with Zn, Zn—Fe, Zn—Al, Zn—Mg, Zn—Al—Mg, Al—Si, Al—Mg—Si, or the like in the thickness of 10 to 200 μm per one side thereof, thereby forming both sides-coated steel sheet.

In the steel sheet manufactured as above method, retained austenite, carbide or the like of 1% or more is dispersed in a ferrite matrix, so that the tensile strength is high in the level of 600 to 100 Mpa, the ductility is excellent, and therefore the combination of strength-ductility is also excellent. Further, in the condition of 2.5 mm cutoff after 5% elongation, the ridging level is 10 μm or less and thus the ridging resistibility is excellent, so that the steel sheet can be manufactured into a hot-rolled steel sheet, a cold rolled steel sheet, and a galvanized steel sheet.

The present invention will now be described in detail with reference to exemplary examples. However, the examples are for only illustrative purposes, and are not intended to restrict the scope of the present invention.

Example 1

A steel slab having composition shown in Table 1 below was manufactured through vacuum induction melting, was heated at 1100° C., and finally was hot rolled in the temperature range of 780° C. to 820° C. The thickness of the hot-rolled steel sheet was 3.2 mm, and the hot-rolled steel sheet was held under the temperature of 500 to 700 for one hour, was cooled in the furnace to room temperature, and was scaled, thereby manufacturing a cold rolled steel sheet having thickness of 0.8 mm. Particularly, in the case of sample steel 2, a mold in a vacuum induction melting furnace was preheated to 900° C. and then was annealed so as to manufacture a slab having low ratio of equiaxed dendrite. The slab was cold rolled under the condition of reheating temperature of 1250° C., hot-rolled coiling temperature of 700° C., and cold rolling reduction of 33%. Then, the resulting slab was heated to 800° C. at a rate of 5° C./s, was held for 60 seconds, was annealed to the range of 600° C. to 680° C., was quenched to 400° C. at a rate of 20° C./s, was held at constant temperature for 100 seconds, was tested in connection with alloying simulation in the temperature range of 500° C.° C. to 580° C., and was cooled to room temperature, thereby fabricating a steel sheet.

TABLE 1

| No. | C | Si | Mn | P | S | Al | Others | N | Mn/Al | Note |
|---|---|---|---|---|---|---|---|---|---|---|
| 1 | 0.4 | 0.01 | 4.5 | 0.01 | 0.003 | 8.5 | — | 0.004 | 0.53 | Sample Steel 1 |
| 2 | 0.6 | 0.01 | 7.4 | 0.01 | 0.002 | 11 | — | 0.005 | 0.67 | Sample Steel 2 |
| 3 | 0.2 | 0.03 | 2.8 | 0.014 | 0.003 | 5.4 | — | 0.004 | 0.52 | Sample Steel 3 |
| 4 | 0.3 | 0.01 | 3.5 | 0.012 | 0.004 | 6.2 | — | 0.003 | 0.56 | Sample Steel 4 |
| 5 | 0.28 | 0.01 | 6.4 | 0.012 | 0.006 | 7.3 | — | 0.004 | 0.88 | Sample Steel 5 |

TABLE 1-continued

| No. | C | Si | Mn | P | S | Al | Others | N | Mn/Al | Note |
|---|---|---|---|---|---|---|---|---|---|---|
| 6 | 0.25 | 0.03 | 3.2 | 0.014 | 0.003 | 5.4 | Nb 0.04, Cr 0.1 | 0.003 | 0.59 | Sample Steel 6 |
| 7 | 0.2 | 0.03 | 2.6 | 0.014 | 0.006 | 5.1 | Ti 0.02, Mo 0.06 | 0.003 | 0.51 | Sample Steel 7 |
| 8 | 0.25 | 0.02 | 3.2 | 0.007 | 0.012 | 6.4 | Ni 0.1, Zr 0.01, Ca 0.001 | 0.004 | 0.50 | Sample Steel 8 |
| 9 | 0.3 | 0.01 | 3.6 | 0.012 | 0.004 | 6.8 | Cu 0.1, B 0.001 | 0.003 | 0.53 | Sample Steel 9 |
| 10 | 0.32 | 0.01 | 3.5 | 0.012 | 0.004 | 6.2 | W 0.1, Sb 0.03 | 0.004 | 0.56 | Sample Steel 10 |
| 11 | 0.2 | 1.5 | 2.2 | 0.02 | 0.006 | 12 | — | 0.004 | 0.18 | Comparative Steel 1 |
| 12 | 0.14 | 0.02 | 2.3 | 0.01 | 0.007 | 8.5 | — | 0.004 | 0.27 | Comparative Steel 2 |
| 13 | 0.08 | 1.5 | 2.3 | 0.01 | 0.002 | 6.2 | — | 0.003 | 0.37 | Comparative Steel 3 |
| 14 | 0.02 | 0.12 | 2 | 0.014 | 0.002 | 6.2 | Nb 0.04 | 0.004 | 0.32 | Comparative Steel 4 |
| 15 | 0.24 | 0.03 | 5.5 | 0.01 | 0.003 | 5 | Nb 0.03 | 0.005 | 1.10 | Comparative Steel 5 |

In the respective sample steels and comparative steels, retained austenite was measured using a magnetic saturation method. Height of ridging was evaluated in such a manner that a cutoff having a length of 2.5 mm, which is perpendicular to the rolling direction, is formed, and amplitude difference in roughness is used to evaluate the ridging. The sample steels has the ratio of Mn/Al of 0.4 to 1.0. Particularly, sample steels 6 to 10 are steels in which the very small quantities of alloying elements, e.g. Nb, are further added. On the contrary, in the case of comparative steels, some elements are not within adequate range, or otherwise the ratio of Mn/Al does not satisfy the range of the present invention.

Table 2 shows manufacturing conditions for the sample steels and the comparative steels, and mechanical properties of the steels manufactured under the conditions.

The respective sample steels shown that height of ridging is below 5 μm, the tensile strength is 661 to 997 Mpa and elongation percentage is 29% or more. The values of the tensile strength and the elongation percentage belong to excellent range. Further, the amount of retained austenite was of high values. On the contrary, in the case of the comparative steels, height of ridging was too high, tensile strength and elongation percentage were low, and a problem occurred that hot cracks were created as Al content increased.

In the case of comparative example 1 employing sample steel 2, nevertheless the composition satisfies the range of the present invention, re-heating temperature and hot rolled coiling temperature were high, but the cold rolling reduction was low, so that the strength was reduced because coarse crystal grains could not be refined, the ridging was greatly devel-

TABLE 2

| Type | RHT*1 (° C.) | WT*2 (° C.) | CRR*3 (%) | AT*4 (° C.) | TS (MPa) | El (%) | RA*5 (%) | Crack | Ridging (μm) |
|---|---|---|---|---|---|---|---|---|---|
| S*6 1 (E*7 1) | 1100 | 500 | 73 | 800 | 898 | 31.1 | 8.2 | No | 1.1 |
| S2 (E2) | 1100 | 500 | 73 | 800 | 997 | 33.9 | 13.5 | No | 0.6 |
| S3 (E3) | 1100 | 500 | 73 | 800 | 661 | 31.4 | 1.6 | No | 4 |
| S4 (E4) | 1100 | 500 | 73 | 800 | 776 | 31.6 | 5.4 | No | 2.8 |
| S5 (E5) | 1100 | 500 | 73 | 800 | 787 | 29 | 6.9 | No | 3.2 |
| S6 (E6) | 1100 | 550 | 73 | 800 | 720 | 29.3 | 3.2 | No | 1.4 |
| S7 (E7) | 1100 | 550 | 73 | 800 | 657 | 30 | 2.7 | No | 2.6 |
| S8 (E8) | 1100 | 550 | 73 | 800 | 731 | 31 | 3.0 | No | 2.8 |
| S9 (E9) | 1100 | 550 | 73 | 800 | 768 | 30 | 5.9 | No | 1.7 |
| S10 (E10) | 1100 | 500 | 73 | 800 | 798 | 32.1 | 5.1 | No | 1.6 |
| S2 (CE*8 1) | 1250 | 700 | 33 | 800 | 967 | 27.8 | 8.8 | No | 16.4 |
| CS*9 11 (CE2) | 1100 | 540 | 73 | 800 | 882 | 18.4 | 0 | Yes | 38 |
| CS12 (CE3) | 1100 | 500 | 73 | 800 | 646 | 29 | 0 | Yes | 8 |
| CS13 (CE4) | 1100 | 700 | 73 | 800 | 677 | 27.2 | 0 | No | 40 |
| CS14 (CE5) | 1100 | 500 | 73 | 800 | 515 | 23.1 | 0 | No | 26 |
| CS15 (CE6) | 1100 | 500 | 73 | 800 | 928 | 19.7 | 0 | Yes | 0.42 |

Notes)
RHT*1: Re-Heating Temperature,
WT*2: Coiling Temperature,
CRR*3: Cold Reduction Ratio,
AT*4: Annealing Temperature,
RA*5: Retained Austenite,
S*6: Sample Steel,
E*7: Example,
CE*8: Comparative Example,
CS*9: Comparative Sample oped, and in spite of low strength thanks to the ridging, elongation percentage was low. Further, in the case of comparative example C, nevertheless of low content of carbon, height of ridging was lowest, but the ratio of Mn/Al exceeded 1, so that fine kappa carbides were greatly precipitated on grain boundaries, resulting in development of fine cracks from an edge during cold rolling. It can be known from this that boundary-precipitated kappa carbides reduce the ductility without contributing to the strength, and cause the creation of cracks, particularly during cold rolling, so that the ratio of Mn/Al is preferably selected to 1.0 or less.

Example 2

In this example, relation between height of ridging and ratio of Mn/Al was examined, and the result was shown in FIG. 1. In FIG. 1, it can be known that if the ratio of Mn/Al is below 0.4, hot cracks occur severely, and the height of ridging increases exponentially. In the case of comparative steels, because of low ratio of Mn/Al, ratio of equiaxed dendrite and austenite-forming temperature and amount were low. In comparison with sample steel 2 having the same composition, it can be know that if the comparative steels are not re-heated at low temperature, they cannot avoid the occurrence of the ridging, so that the surface of a product becomes rough, and sectional contraction occurs locally, causing the creation of working cracks.

Figure 2A:
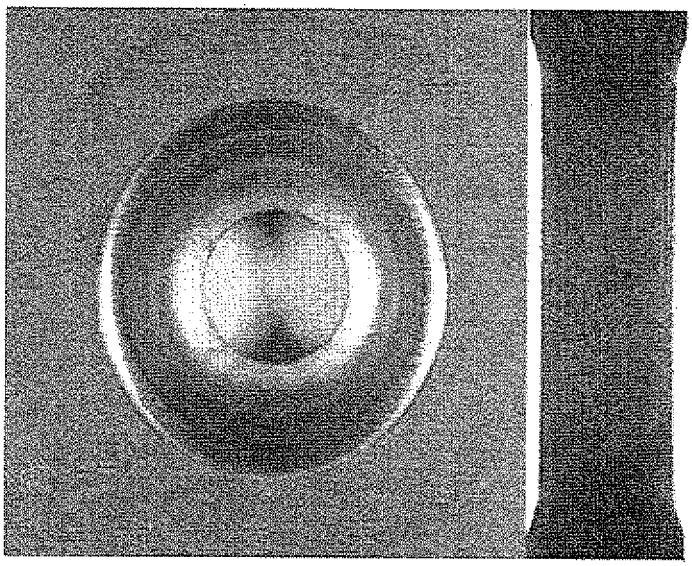
FIGS. 2A and 2B are a photographical representation illustrating an effect of ridging on forming via the implementation of hole-expansion test to samples.
Figure 2B:
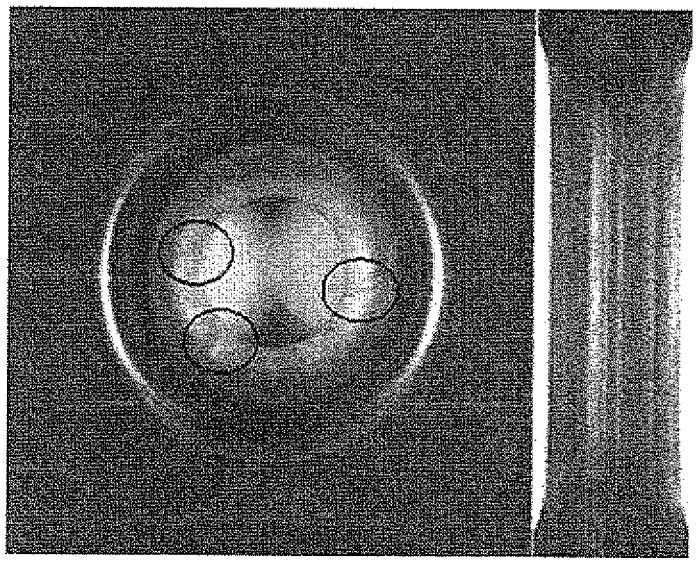

In specific, a hole-enlarging test was carried out to the sample steel 3 and comparative steel 6, which have similar tensile strength and elongation percentage, so as to examine the effect of ridging upon forming (See FIGS. 2A and 2B). The height of ridging in sample steel 3 was 4 μm, which was the highest value in the sample steels, and the height of ridging in the comparative steel 6 was 40 μm. After elongation of 5%, the samples were photographed from side view, and the photographs were shown in FIGS. 2A and 2B. As a result, although generally, it has been known that high elongation decreases the hole-enlarging capability, according to this example, the sample steel 3 (FIGS. 2A and 2B), which had relatively high elongation percentage, shown excellent hole-enlarging capability and workability, and further had a smooth surface even after forming. This is assumed that in the case of comparative steel 6 (FIG. 2B), the ridging occurs greatly and thus fine cracks are created in the enlarged hole, so that working of similar level cannot be applied to the comparative steel 6.

While the present invention has been shown and described in connection with the exemplary embodiments, it will be apparent to those skilled in the art that modifications and variations can be made without departing from the spirit and scope of the invention as defined by the appended claims.

What is claimed is:

1. A low specific gravity and high strength steel sheet comprising on the basis of weight %: C: 0.2% to 0.8%, Mn: 2% to 10%, P: 0.02% or less, S: 0.015% or less, Al: 5.1% to 15%, and N: 0.01% or less, wherein a ratio of Mn/Al is 0.4 to 1.0, wherein the steel sheet has ridging height of 10 μm or less under conditions of 2.5 mm cutoff after 5% elongation, and wherein retained austenite in a structure is included within a range of 1% or more.

2. The steel sheet of claim 1, further comprising one or two or more elements selected from the group consisting of on the basis of weight %: Si: 0.1% to 2.0%, Cr: 0.1% to 0.3%, Mo: 0.05% to 0.5%, Ni: 0.1% to 2.0%, Cu: 0.1% to 1.0%, B: 0.0005% to 0.003%, Ti: 0.01% to 0.2%, Zr: 0.005% to 0.2%, Nb: 0.005% to 0.2%, W: 0.1% to 1.0%, Sb: 0.005% to 0.2%, and Ca: 0.001% to 0.2%.

3. The steel sheet of claim 1, comprising on the basis of weight %: C: 0.6%.

4. The steel sheet of claim 1, wherein the steel sheet has tensile strength of 600 to 1000 Mpa and specific gravity of 7.2 g/cm$^3$ or less.

5. The steel sheet of claim 2, wherein the steel sheet has tensile strength of 600 to 1000 Mpa and specific gravity of 7.2 g/cm$^3$ or less.

6. A low specific gravity and high strength galvanized steel sheet comprising on the basis of weight %: C: 0.2% to 0.8%, Mn: 2% to 10%, P: 0.02% or less, S: 0.015% or less, Al: 5.1% to 15%, and N: 0.01% or less, wherein a ratio of Mn/Al is 0.4 to 1.0, wherein retained austenite in a structure is included within a range of 1% or more, wherein the steel sheet has ridging height of 10 μm or less under conditions of 2.5 mm cutoff after 5% elongation, and wherein one of coating layers consisting of Zn, Zn—Fe, Zn—Al, Zn—Mg, Zn—Al—Mg, Al—Si, and Al—Mg—Si in thickness of 10 μm to 200 μm per one side thereof is coated on the surface thereof.

7. The steel sheet of claim 6, further comprising one or two or more elements selected from the group consisting of on the basis of weight %: Si: 0.1% to 2.0%, Cr: 0.1% to 0.3%, Mo: 0.05% to 0.5%, Ni: 0.1% to 2.0%, Cu: 0.1% to 1.0%, B: 0.0005% to 0.003%, Ti: 0.01% to 0.2%, Zr: 0.005% to 0.2%, Nb: 0.005% to 0.2%, W: 0.1% to 1.0%, Sb: 0.005% to 0.2%, and Ca: 0.001% to 0.2%.

8. The steel sheet of claim 6, wherein the steel sheet has tensile strength of 600 to 1000 Mpa and specific gravity of 7.2 g/cm$^3$ or less.

9. The steel sheet of claim 7, wherein the steel sheet has tensile strength of 600 to 1000 Mpa and specific gravity of 7.2 g/cm$^3$ or less.

10. A manufacturing method of low specific gravity and high strength hot-rolled steel sheet using a steel slab comprising on the basis of weight %: C: 0.2% to 0.8%, Mn: 2% to 10%, P: 0.02% or less, S: 0.015% or less, Al: 5.1% to 15%, and N: 0.01% or less, wherein a ratio of Mn/Al is 0.4 to 1.0, the method comprising: heating the steel slab within a range between 1000° C. and 1200° C.; finishing hot-rolling the heated steel slab within a range between 700° C. and 850° C.; and coiling the hot-rolled steel slab at 600° C. or less.

11. The manufacturing method of claim 10, wherein the steel slab further comprises one or two or more elements selected from the group consisting of on the basis of weight %: Si: 0.1% to 2.0%, Cr: 0.1% to 0.3%, Mo: 0.05% to 0.5%, Ni: 0.1% to 2.0%, Cu: 0.1% to 1.0%, B: 0.0005% to 0.003%, Ti: 0.01% to 0.2%, Zr: 0.005% to 0.2%, Nb: 0.005% to 0.2%, W: 0.1% to 1.0%, Sb: 0.005% to 0.2%, and Ca: 0.001% to 0.2%.

12. A manufacturing method of low specific gravity and high strength cold rolled steel sheet using a steel slab comprising on the basis of weight %: C: 0.2% to 0.8%, Mn: 2% to 10%, P: 0.02% or less, S: 0.015% or less, Al: 5.1% to 15%, and N: 0.01% or less, wherein a ratio of Mn/Al is 0.4 to 1.0, the method comprising: heating the steel slab within a range between 1000° C. and 1200° C.; finishing hot-rolling the heated steel slab within a range between 700° C. and 850° C.; coiling the hot-rolled steel slab at 600° C. or less; cold-rolling the hot-rolled steel slab at a rolling reduction of 40% to 90%; and annealing the cold-rolled steel slab within a temperature range between recrystallization temperature and 900° C. at an annealing rate of 1 to 20° C./s for 10 to 180 seconds.

13. The manufacturing method of claim 12, wherein the steel slab further comprises one or two or more elements selected from the group consisting of on the basis of weight %: Si: 0.1% to 2.0%, Cr: 0.1% to 0.3%, Mo: 0.05% to 0.5%, Ni: 0.1% to 2.0%, Cu: 0.1% to 1.0%, B: 0.0005% to 0.003%, Ti: 0.01% to 0.2%, Zr: 0.005% to 0.2%, Nb: 0.005% to 0.2%, W: 0.1% to 1.0%, Sb: 0.005% to 0.2%, and Ca: 0.001% to 0.2%.

14. A manufacturing method of low specific gravity and high strength galvanized steel sheet using a steel slab comprising on the basis of weight %: C: 0.2% to 0.8%, Mn: 2% to 10%, P: 0.02% or less, S: 0.015% or less, Al: 5.1% to 15%, and N: 0.01% or less, wherein a ratio of Mn/Al is 0.4 to 1.0, the method comprising: heating the steel slab within a range between 1000° C. and 1200° C.; finishing hot-rolling the heated steel slab within a range between 700° C. and 850° C.; coiling the hot rolled steel slab at 600° C. or less; cold-rolling the hot-rolled steel slab at a rolling reduction of 40% to 90%; annealing the cold-rolled steel slab within a temperature range between recrystallization temperature and 900° C. at an annealing rate of 1 to 20° C./s for 10 to 180 seconds; and coating the annealed steel slab with one of coating layers consisting of Zn, Zn—Fe, Zn—Al, Zn—Mg, Zn—Al—Mg, Al—Si, and Al—Mg—Si at a thickness of 10 μm to 200 μm per one side thereof.

15. The manufacturing method of claim 14, wherein the steel slab further comprises one or two or more elements selected from the group consisting of on the basis of weight %: Si: 0.1% to 2.0%, Cr: 0.1% to 0.3%, Mo: 0.05% to 0.5%, Ni: 0.1% to 2.0%, Cu: 0.1% to 1.0%, B: 0.0005% to 0.003%, Ti: 0.01% to 0.2%, Zr: 0.005% to 0.2%, Nb: 0.005% to 0.2%, W: 0.1% to 1.0%, Sb: 0.005% to 0.2%, and Ca: 0.001% to 0.2%.

* * * * *